US007611426B1

(12) United States Patent
Bradshaw

(10) Patent No.: US 7,611,426 B1
(45) **Date of Patent: *Nov. 3, 2009**

(54) GOLF BALL MARK REPAIR TOOL

(75) Inventor: Bruce Bradshaw, Clarion, IA (US)

(73) Assignee: Team Effort, Inc., Clarion, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/039,477

(22) Filed: Jan. 19, 2005

(51) Int. Cl.
*A63B 57/00* (2006.01)

(52) U.S. Cl. ..... 473/408; 473/409

(58) Field of Classification Search ..... 473/408; D21/793

See application file for complete search history.

(56) References Cited

U.S. PATENT DOCUMENTS

| | | | | | |
|---|---|---|---|---|---|
| D300,760 | S | * | 4/1989 | Krokus, Sr. | D21/793 |
| 5,121,519 | A | * | 6/1992 | Haugom | 473/408 |
| D360,450 | S | * | 7/1995 | Louden et al. | D21/793 |
| D383,516 | S | * | 9/1997 | Stevens | D21/793 |
| 5,686,158 | A | * | 11/1997 | Gibbon | 473/300 |
| 6,033,322 | A | * | 3/2000 | England | 473/408 |
| D422,664 | S | | 4/2000 | Tate | |
| D424,151 | S | * | 5/2000 | Miura | D21/793 |
| D434,825 | S | * | 12/2000 | Miura | D21/793 |
| D436,152 | S | * | 1/2001 | Sanford, III | D21/793 |
| 6,217,465 | B1 | * | 4/2001 | Kenia, Jr. | 473/408 |
| 6,502,646 | B2 | | 1/2003 | Wiens | |
| D470,556 | S | | 2/2003 | Guerette et al. | |
| 6,565,458 | B1 | | 5/2003 | Cameron | |
| D508,104 | S | * | 8/2005 | Haug | D21/793 |
| 7,238,126 | B1 | * | 7/2007 | Wiens et al. | 473/408 |
| 2001/0029213 | A1 | | 10/2001 | Hendren | |
| 2004/0023733 | A1 | | 2/2004 | Tummillo | |

OTHER PUBLICATIONS

"Leave Your mark on the game—fixing a ball mark on a putting green—Brief Article" Golf Digest, Oct. 1999, 2 pages.
Achenbach, James "Latest News Golfweek", The Problem—The Tools—The Solution—Testimonials, 2004 Green Fix Golf, 13 pages.
"GreenFix Repair Tool Putter Grips" TGW.com, The Golf Warehouse, 2 pages.
"How to Reapir a Ball Mark" GREEN-SAVE.com, 1 page.
Fry, Jack, et al. "Evaluation of Ball Mark Reapir Methods and Creeping Bentgrass Recovery" Greenfix Golf, Inc. pp. 41-46.
"The New, Easy Way to Repair Ball Marks" GreenFix Putter Grips, Swing Science, 2 pages.
Kirkman, Brad "Ask Brad" Triad Golf Today, Triadgolf.com, 2 pages.

* cited by examiner

*Primary Examiner*—Steven Wong
(74) *Attorney, Agent, or Firm*—McKee, Voorhees & Sease, P.L.C.

(57) ABSTRACT

A golf ball mark repair tool having the advantage of promoting the proper technique for repairing a ball mark on a green is provided. The ball mark repair tool generally includes a body member and a plurality of prongs extending from the body member. The prongs have an arcuate shape and project forwardly from the body member to facilitate pushing the edge of the ball mark towards the center. A method of using the ball mark repair tool is also provided.

7 Claims, 2 Drawing Sheets

GOLF BALL MARK REPAIR TOOL

BACKGROUND OF THE INVENTION

1. Field of the Invention

This invention relates generally to golf accessories or tools. More particularly, though not exclusively, the present invention relates to a tool for repairing ball marks on golf greens.

2. Problems in the Art

Golf course superintendents and ground crews spend considerable time and resources maintaining golf greens. Their goal is to provide a healthy, smooth and consistent surface for putting a golf ball. Ball marks are particularly problematic. A ball mark is a depression in the putting green having a sunken center and generally circular walls. Ball marks are created when golf balls hit the green from an approach shot, often a highly lofted shot. Golf etiquette provides that a player should carefully repair any ball marks or other damage to the putting green made by the impact of a ball (whether or not made by the player himself). When ball marks are not repaired, they are a significant impediment on the green for several weeks thereafter. Ball marks that are not repaired or repaired improperly can cause putts to track off line and leave unsightly dead brown spots on the green.

Golfers often use a golf tee or other repair tool to raise the depressed portions of the ball mark and flatten the putting surface. Unfortunately, many golfers "fix" the ball mark using the wrong technique, causing additional damage to the green. Golfers often use a repair tool to lift or twist the depressed portion of the ball mark. Although the putting surface may appear smooth and flat, the lifting or twisting action can tear the roots in the grass, creating dead brown spots that take weeks to recover. In fact, studies have shown that it takes longer for the green to recover from a ball mark improperly repaired as opposed to a mark that is left untouched.

Pushing the compressed grass and walls of the ball mark back toward the center of the mark is the preferred method or technique for repairing a ball mark. The golfer should push inward from several positions around the ball mark, rather than from on just one side. Tapping on top of the ball mark with a putter provides a smooth surface for other players.

Unfortunately, prior art repair tools are not well suited for using such a technique. In fact, many prior art repair tools actually promote a lifting or twisting action that can severe the grass roots and damage the root system of the golf green. For example, U.S. Pat. No. 6,565,458 to Cameron discloses a repair tool having prongs angled away from the handle portion of the tool, promoting a lifting action in repairing the ball mark. The device further includes a pivot member that aids in the lifting action. As another example, U.S. Pat. No. D470,556 issued to Guerette et al. discloses a repair tool having flat prongs that are not coplanar with the handle portion. The prongs are angled such that the golfer will tend to push down on the handle after inserting the prongs into the ground, thereby lifting the depressed portion of the ball mark and further damaging the green. Thus, a need exists in the art for an improved ball mark repair tool that facilitates and promotes the proper technique in repairing ball marks.

A general object of the present invention is the provision of an improved ball mark repair tool.

A further object of the present invention is the provision of an improved ball mark repair tool that promotes the proper technique in fixing ball marks.

A still further object of the present invention is the provision of an improved ball mark repair tool that aids in pushing the soil and grass about the periphery of the ball mark toward the center of the mark.

A further object of the present invention is the provision of an improved ball mark repair tool that minimizes the chance of damage to the root system of the grass.

A still further object of the present invention is the provision of an improved method for repairing ball marks on golf greens.

These as well as other objects, features and advantages of the present invention will become apparent from the following specification and claims.

SUMMARY OF THE INVENTION

The foregoing objects are achieved by a golf ball mark repair tool having a body member and a plurality of prongs extending from the body member. The prongs have an arcuate shape and project forwardly from the body member to facilitate pushing soil about the periphery of the ball mark towards the center of the mark. In a preferred form, the prongs of the repair tool have a convexed portion relative to the front surface of the body member. The prongs of the repair tool are shaped so as to encourage and facilitate the proper technique of pushing grass and soil towards the center of the ball mark, not lifting the depressed portion of the mark thereby tearing or otherwise damaging the roots of the grass.

The present invention also includes a new method of repairing a ball mark that speeds recovery time. The method generally includes providing a golf ball mark repair tool as described above, inserting the prongs of the repair tool into the edge of the ball mark, pushing the edge of the ball mark towards its center, and smoothing the surface of the ball mark.

BRIEF DESCRIPTION OF THE DRAWINGS

The present invention is illustrated by way of example and not limitation in the figures of the accompanying drawings, in which like references indicate similar elements and in which.

DETAILED DESCRIPTION OF THE PREFERRED EMBODIMENT

Figure 1:
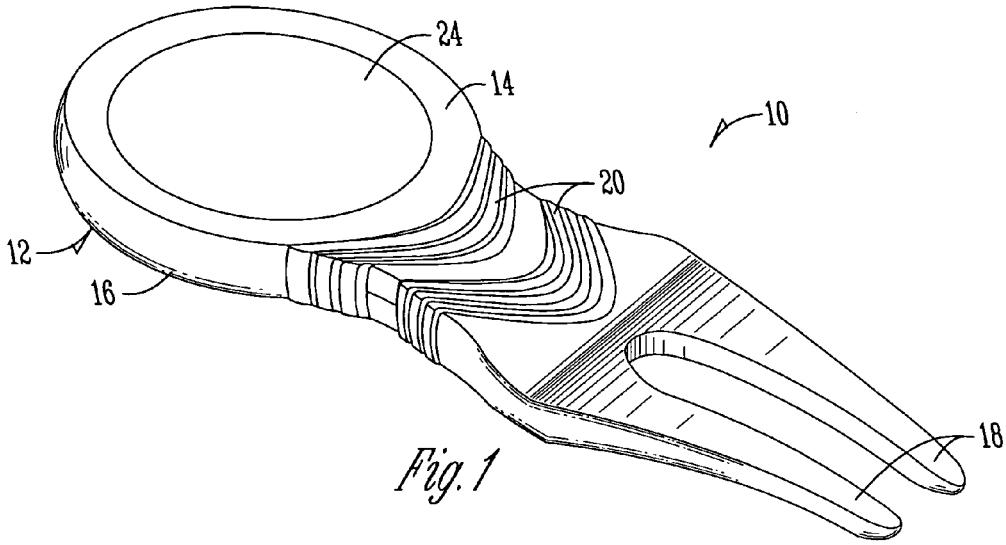
FIG. 1 is a perspective view of a preferred embodiment of the ball mark repair tool of the present invention.
Figure 2:
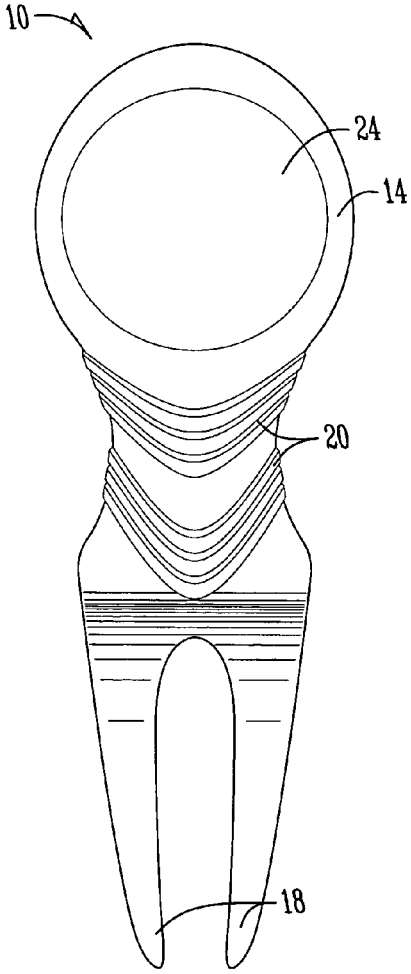
FIG. 2 is a front elevational view of the ball mark repair tool.

A preferred embodiment of the ball mark repair tool of the present invention is referred to in FIG. 1 generally by the reference numeral 10. The shape and features of the repair tool 10 are shown in FIGS. 1-5. It is seen that the repair tool 10 includes a body member 12 and prongs 18 extending therefrom. The body member 12 includes a generally circular portion that tapers and transitions on one side into the prongs 18. The body member 12 includes a front surface 14 and an opposite back surface 16. The body member 12 and prongs 18 are integrally formed from a cast metal. Those skilled in the art will appreciate that the repair tool 10 could be milled from different metals or made of aluminum.

Figure 3:
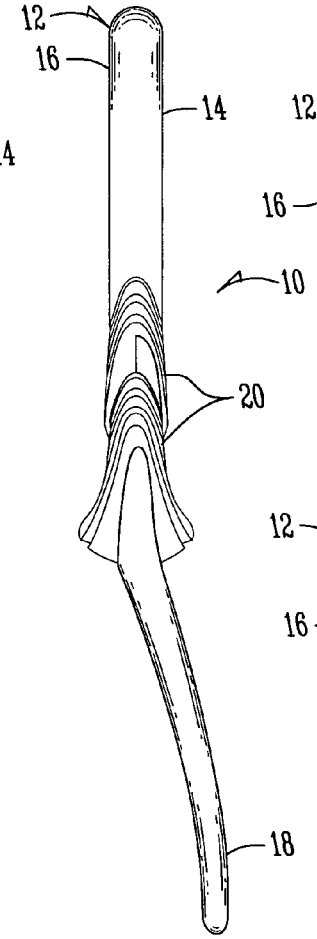
FIG. 3 is a side elevational view of the ball mark repair tool.
Figure 4:
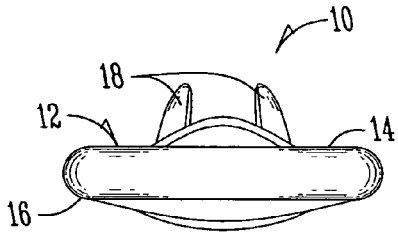
FIG. 4 is a bottom elevational view of the ball mark repair tool.
Figure 5:
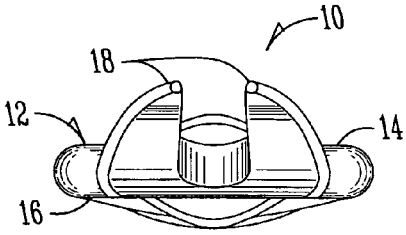
FIG. 5 is a top elevational view of the ball mark repair tool.

The body member 12 provides a handle for the golfer to grip the repair tool 10. A molded rubber portions 20, 22 are adhered to the cast metal as shown in FIGS. 3 and 4. The molded rubber portions 20, 22 provide a gripping surface and help properly position the user's fingers and thumb on the repair tool 10.

The body member 12 includes a recessed area 24 for receiving a circular ball marker. The ball marker is made of metal and can be held in place in the recessed area 24 with a high-strength magnet.

As best shown in FIG. 3, the prongs 18 of the repair tool 10 have an arcuate shape and project forwardly from the body member. The body member extends generally along a first axis and the prongs extend generally along a second axis which is obtuse to the first axis. The prongs are spaced apart and have a convexed shape relative to the front surface 14 of the body member. Each prong has a convex side and a concave side, the concave side facing towards the first axis and the convex side facing away from the first axis. In a preferred form, the convexed portion has an arc length of approximately 2½ to 3½ cm and an arc angle of approximately 10° to 45°. A repair tool having an arc length of approximately 3 cm and an arc angle of approximately 30° has been found suitable. The width of each prong 18 decreases as the prong 18 extends away from the body member 12.

It is the unique shape of the prongs 18 that help encourage and facilitate the proper technique in fixing ball marks. The arcuate shape of the prong 18 helps encourage the user to push the soil and grass about the edge of the ball mark towards the center of the mark. The convex shape of the prongs 18 also helps to provide mechanical advantage in this respect.

Figure 6:
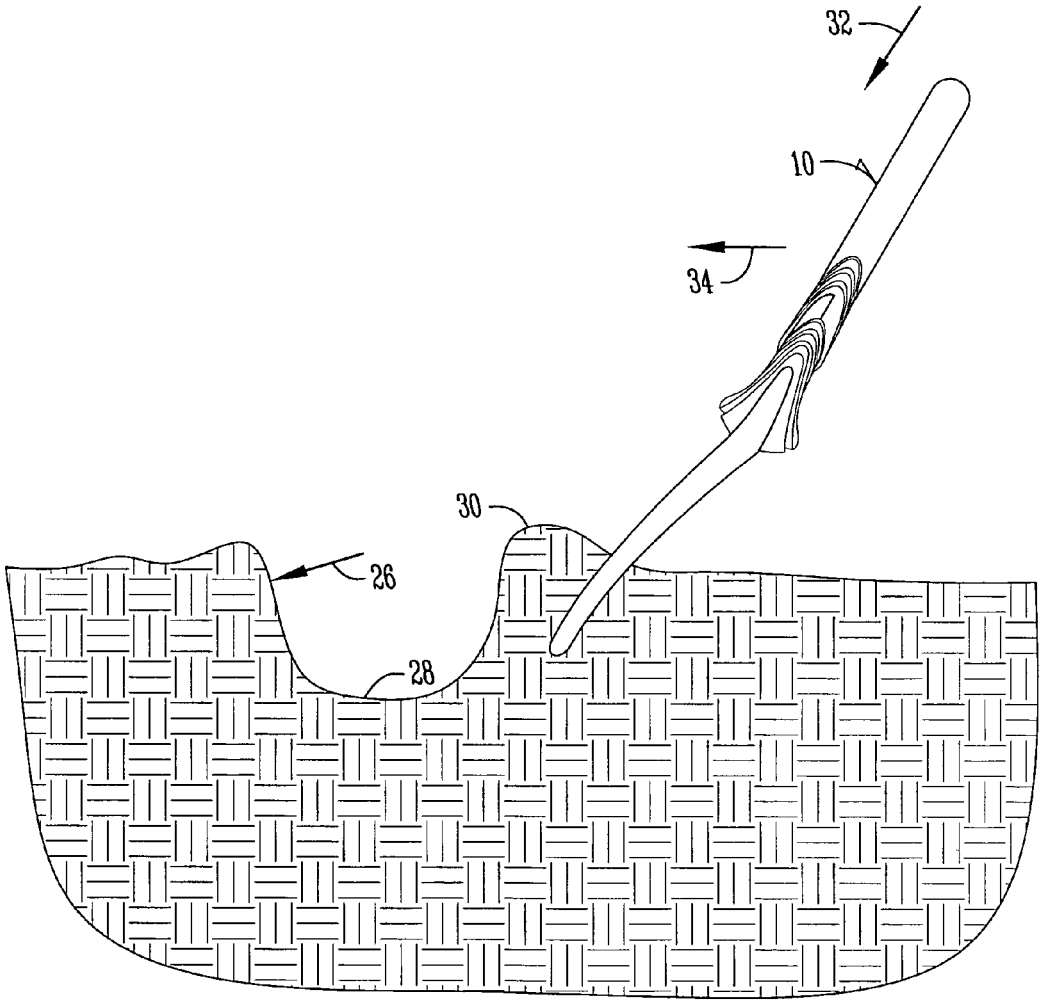
FIG. 6 is a side view of the ball mark repair tool, illustrating the preferred method of repairing ball marks.

The preferred method of using the golf ball repair tool 10 is illustrated in FIG. 6. A ball mark 26 including a depressed or indented portion 28 with a peripheral edge 30 is shown. The prongs 18 of the repair tool 10 are inserted outside the edge or ridge 30 of the ball mark in the direction of arrow 32 with the convex sides facing generally the center of the ball mark. The soil is then pushed towards the center of the ball mark as shown by the direction of the arrow 34. This process is repeated at various locations about the periphery of the ball mark 26. The surface of the ball mark 26 is then flattened or smoothed, such as by tapping with the head of a putter.

Those skilled in the art will appreciate that the shape of the prongs 18 relative to the body member 12 improves the ability of the repair tool 10 to move soil about the periphery of the ball mark towards the center of the mark. Those skilled in the art will further appreciate that the shape of the prongs 18 relative to the body member 12 discourages against pulling back on the body member 12, which would cause the prongs to lift soil and possibly tear grass roots adjacent the depressed portion 28 of the ball mark 26.

Using the golf ball repair tool 10 as described herein helps restore the effected area of the golf green to a smooth and flat surface while also minimizing any damage to the root system of the grass. Preventing damage to the root system helps speed the recovery time of the green.

In the preceding detailed description, the invention is described by reference to specific exemplary embodiments thereof. Modifications and changes may be made hereto without departing from the spirit and scope of the invention as set forth in the claims. The specification is, accordingly, to be regarded in an illustrative rather than a restrictive sense. The invention is to be limited only by the claims appended hereto.

What is claimed is:

1. A new method of repairing a ball mark on a golf green that speeds recovery time, the ball mark having a peripheral edge and a center, the method comprising:

providing a golf ball mark repair tool having a body member generally along a first axis and a plurality of prongs extending from the body member generally along a second axis which is obtuse to the first axis, wherein each prong further comprises a bowed shape having a convex side and a concave side, the concave sides facing towards the first axis and the convex sides facing away from the first axis;

inserting the prongs at least partially into the golf green and at or near the peripheral edge of the ball mark with the convex sides facing generally the center of the ball mark;

pushing the body member towards the center of the ball mark to push the edge of the ball mark and adjacent green inward towards the ball mark center at and near the location of the inserted prongs with the of the prongs; and smoothing the green at the ball mark.

2. The method of repairing a ball mark of claim 1 wherein the prongs are inserted into or near the peripheral edge of the ball mark at a plurality of locations around the center of the ball mark and the edge of the ball mark and adjacent green is pushed towards the center of the ball mark with the bowed shape of the prongs at the plurality of locations.

3. The method of repairing a ball mark of claim 1 wherein the step of smoothing the green at the ball mark includes tapping a putter head on the ball mark.

4. A new method of repairing a ball mark on a golf green that speeds recovery time, the ball mark having a peripheral edge and a center, the method comprising:

providing a golf ball mark repair tool having a body member generally along a first axis and a plurality of prongs extending from the body member along a second axis which is obtuse to the first axis, wherein each prong further comprises a bowed shape having a convex side and a concave side, the concave sides facing towards the first axis and the convex sides facing away from the first axis ending at distal points;

inserting the prongs at least partially into the golf green and at or near the peripheral edge of the ball mark with the convex sides facing generally the center of the ball mark;

rotating bowed shaped prongs about the distal points of the prongs pushing the body member towards the center of the ball mark to push the edge of the ball mark and adjacent green inward towards the ball mark center at and near the location of the inserted prongs; and smoothing the green at the ball mark.

5. The method of repairing a ball mark of claim 4 wherein the prongs are inserted into or near the peripheral edge of the ball mark at a plurality of locations around the center of the ball mark and the edge of the ball mark and adjacent green is pushed towards the center of the ball mark with the bowed shape of the prongs at the plurality of locations.

6. The method of repairing a ball mark of claim 4 wherein the step of smoothing the green at the ball mark includes tapping a putter head on the ball mark.

7. A new method of repairing a ball mark on a golf green that speeds recovery time, the ball mark having a peripheral edge and a center, the method comprising:

providing a golf ball mark repair tool having a body member generally along a first axis, a gripping surface adapted to position a user's thumb on a front surface of the body member, and a plurality of prongs extending from the body member generally along a second axis which is obtuse to the first axis, each of the prongs having a bowed shape with a convex side and a concave side the concave sides facing towards the first axis and the convex sides facing away from the first axis and projecting forwardly away from the front surface of the body member;

inserting the prongs at least partially into the golf green and at or near the peripheral edge of the ball mark with the convex sides facing generally the center of the ball mark;

pushing the edge of the ball mark inward towards its center with the convex shaped prongs; and smoothing the green at the ball mark.

* * * * *

UNITED STATES PATENT AND TRADEMARK OFFICE

CERTIFICATE OF CORRECTION

PATENT NO. : 7,611,426 B1
APPLICATION NO. : 11/039477
DATED : November 3, 2009
INVENTOR(S) : Bruce Bradshaw It is certified that error appears in the above-identified patent and that said Letters Patent is hereby corrected as shown below:

Col. 4, Claim 1, Line 7:
After prongs with the, ADD --bowed shape--

Signed and Sealed this

Twenty-ninth Day of December, 2009

David J. Kappos

David J. Kappos
*Director of the United States Patent and Trademark Office*